US006050742A

United States Patent [19]

Held et al.

[11] Patent Number: 6,050,742

[45] Date of Patent: Apr. 18, 2000

[54] PAVEMENT MARKER

[75] Inventors: Jeffery S. Held, Chicago, Ill.; Robert D. Giese, Racine, Wis.

[73] Assignee: Energy Absorption Systems, Inc., Chicago, Ill.

[21] Appl. No.: 08/780,378

[22] Filed: Jan. 8, 1997

Related U.S. Application Data

[60] Provisional application No. 60/012,903, Mar. 6, 1996.

[51] Int. Cl.[7] ..... E01F 9/07

[52] U.S. Cl. ..... 404/10; 404/11; 404/12; 404/14; 404/73; 404/94

[58] Field of Search ..... 404/9, 11, 12, 404/14, 15, 16, 90, 93, 94, 10, 73; 116/63 P, 63 R

[56] References Cited

U.S. PATENT DOCUMENTS

| | | | |
|---|---|---|---|
| D. 266,060 | 9/1982 | Beretta . | |
| D. 266,554 | 10/1982 | Beretta . | |
| D. 327,230 | 6/1992 | Hedgewick . | |
| D. 346,984 | 5/1994 | Hedgewick . | |
| D. 348,411 | 7/1994 | Hedgewick . | |
| B 358,174 | 1/1975 | Rowland . | |
| 1,295,021 | 2/1919 | Friel . | |
| 2,192,878 | 3/1940 | Beebe | 404/16 X |
| 2,941,447 | 6/1960 | Abbott, Sr. | 404/11 |
| 3,257,552 | 6/1966 | Converso | 404/10 X |
| 3,292,506 | 12/1966 | Kone | 404/11 |
| 3,377,930 | 4/1968 | Kone | 404/11 |
| 3,499,371 | 3/1970 | Jonnes et al. . | |
| 3,703,855 | 11/1972 | Converso | 404/11 |
| 3,717,076 | 2/1973 | Shields . | |
| 3,850,536 | 11/1974 | Kone | 404/11 |
| 3,879,148 | 4/1975 | Eigenmann . | |
| 3,901,614 | 8/1975 | Overacker . | |
| 3,924,958 | 12/1975 | Rowland | 404/15 |
| 4,028,293 | 6/1977 | Van Den Berg | 404/17 X |
| 4,049,358 | 9/1977 | King et al. . | |
| 4,147,447 | 4/1979 | Heenan et al. . | |
| 4,155,666 | 5/1979 | Flanagan . | |

(List continued on next page.)

FOREIGN PATENT DOCUMENTS

| | | |
|---|---|---|
| 411003 | 2/1971 | Australia . |
| 1190258 | 4/1970 | United Kingdom . |
| WO 88/07606 | 10/1988 | WIPO . |

OTHER PUBLICATIONS

Brochure The Best Show on the Road, IroinStar from Hallen Products, Copyright 1997 Hallen Products, Ltd.

Brochure Stimsonite Recyclable, Snowplowable Reflective Pavement Markers, 1994 Stimsonite Corporation.

*Primary Examiner*—James A. Lisehora

*Attorney, Agent, or Firm*—Brinks Hofer Gilson & Lione

[57] ABSTRACT

A raised pavement marker includes a rigid reflector assembly that supports two retroreflectors. The reflector assembly is resiliently mounted over a base by a resilient membrane, which is secured to the base at its outer edge. When a vehicle contacts the reflector housing, downward forces supplied by the vehicle to the reflector housing deform the membrane, which allows the reflector housing to move downwardly to pavement level. After the vehicle has passed, the resilience of the membrane restores the reflector assembly to its raised position. Methods for installing and removing the pavement marker are disclosed.

9 Claims, 5 Drawing Sheets

U.S. PATENT DOCUMENTS 4,174,184 11/1979 Heenan .
4,186,968 2/1980 Barton ..... 299/39
4,188,150 2/1980 Sroka ..... 404/11
4,195,945 4/1980 Heenan .
4,218,059 8/1980 Eiden ..... 404/11 X
4,232,979 11/1980 Johnson, Jr. et al. .
4,234,264 11/1980 Baldi .
4,340,319 7/1982 Johnson, Jr. et al. .
4,362,425 12/1982 Dixon .
4,504,169 3/1985 Jones .
4,507,254 3/1985 Daniels et al. .
4,557,624 12/1985 Walker .
4,595,312 6/1986 Corless ..... 404/11
4,596,622 6/1986 Heenan et al. .
4,597,691 7/1986 Clarke ..... 404/11
4,618,281 10/1986 Ajemian .
4,653,955 3/1987 Racs .
4,753,548 6/1988 Forrer .
4,797,024 1/1989 Forrer .
4,848,958 7/1989 Sheldon ..... 404/11
4,854,768 8/1989 Flanagan et al. .
4,883,384 11/1989 Hedgewick .
4,955,982 9/1990 Paulos .
5,002,424 3/1991 Hedgewick .
5,061,114 10/1991 Hedgewick .
5,069,577 12/1991 Murphy ..... 404/11
5,074,706 12/1991 Paulos ..... 404/11 X
5,098,217 3/1992 Hedgewick et al. .
5,219,171 6/1993 Kirby et al. .
5,226,745 7/1993 Gartlacher .
5,277,513 1/1994 Flanagan et al. .
5,302,048 4/1994 Paulos et al. ..... 404/11
5,308,186 5/1994 Hedgewick .
5,314,268 5/1994 Calandra, Jr. .
5,340,103 8/1994 Kirby et al. .
5,354,143 10/1994 Lindner .
5,393,166 2/1995 Stock et al. .
5,449,244 9/1995 Sandino .
5,454,664 10/1995 Siblik .
5,472,737 12/1995 Anders ..... 427/137
5,502,593 3/1996 Hedgewick .
5,529,430 6/1996 Jenkins ..... 404/11
5,564,854 10/1996 Hedgewick .
5,665,793 9/1997 Anders ..... 523/172
5,681,128 10/1997 Morgan et al. ..... 404/15 X
5,857,801 1/1999 Brown .
5,895,170 4/1999 Chambers et al. .

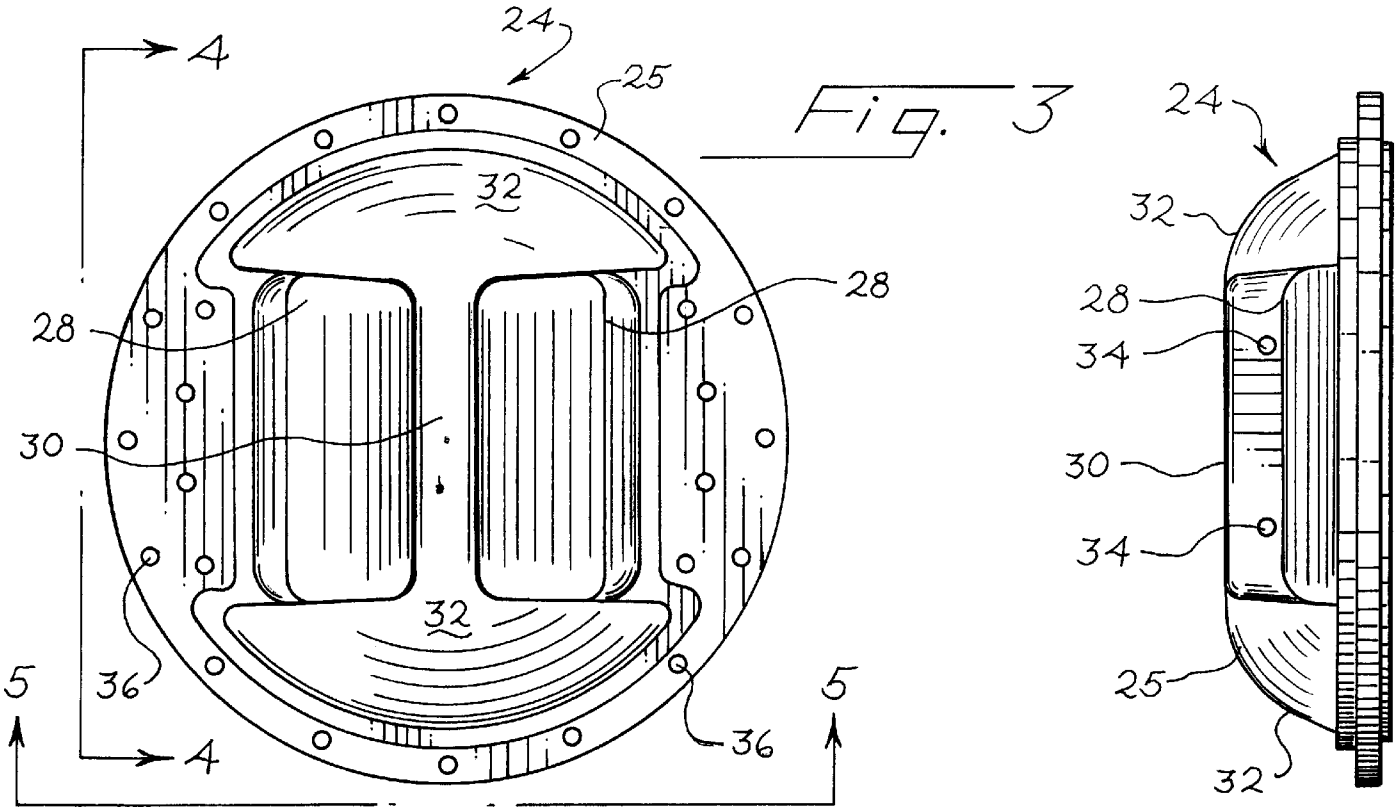
Fig. 3
Fig. 4
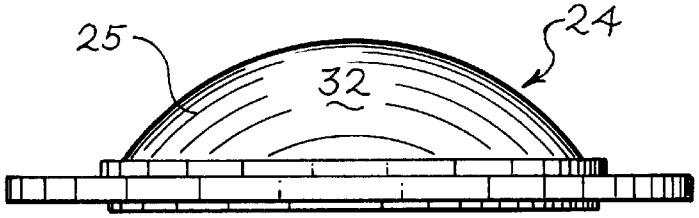
Fig. 5

Fig. 6
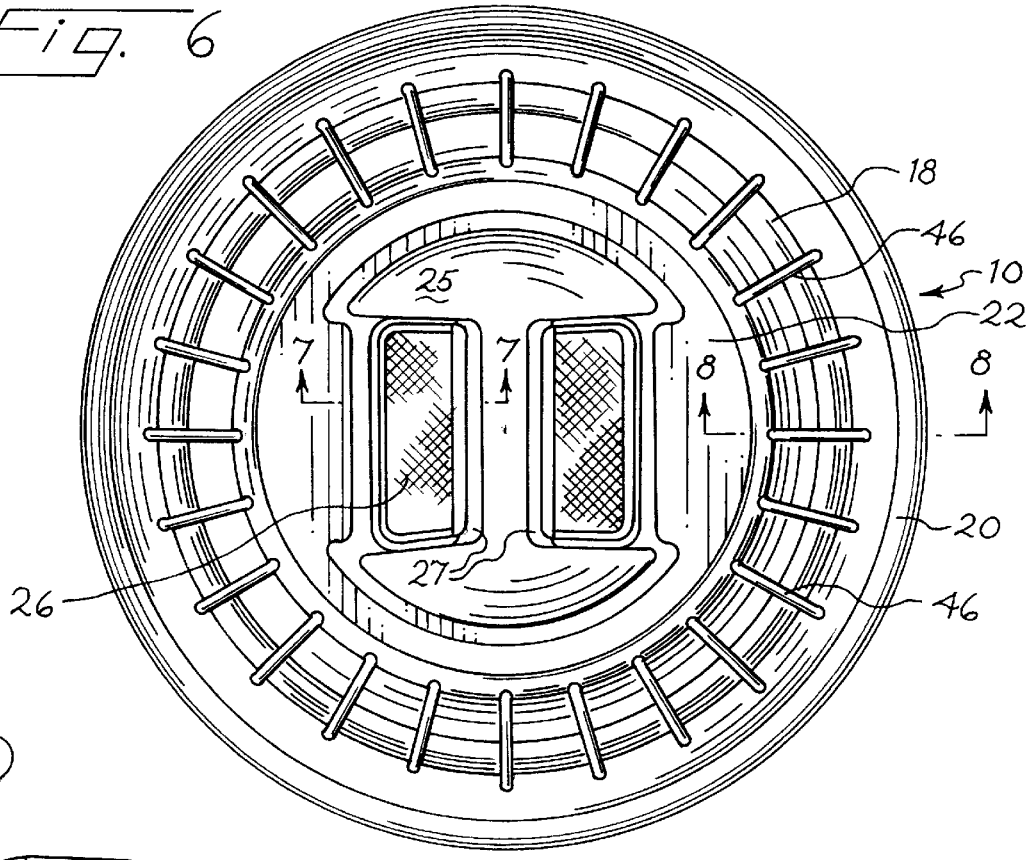
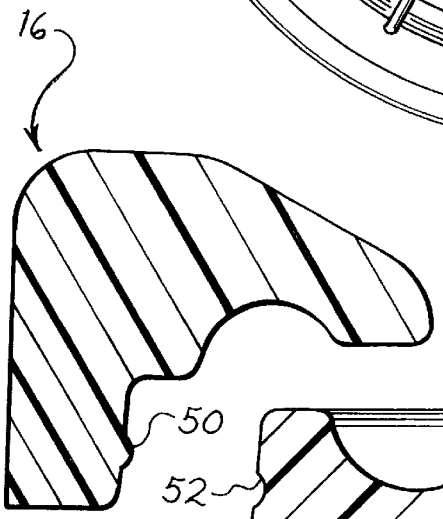
Fig. 9
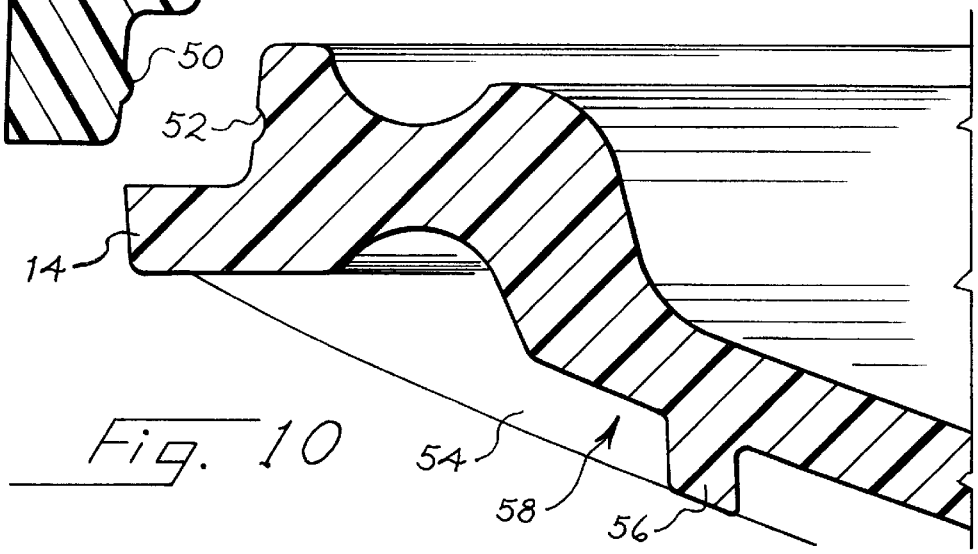
Fig. 10

PAVEMENT MARKER

This application claims the benefit of provisional U.S. patent application Serial No. 60/012,903, filed Mar. 6, 1996, which is hereby incorporated by reference in its entirety.

BACKGROUND OF THE INVENTION

Raised pavement markers have been used in the past to mark lane lines in a roadway. In many cases, it is important that the raised pavement marker move to allow a snow plow blade to pass over the marker without damage to the marker. Four prior art pavement markers of this type are described in Stolarczyk U.S. Pat. No. 3,216,335, Baldi U.S. Pat. No. 4,234,264, Robinson U.S. Pat. No. 4,297,051, and Paulos U.S. Pat. No. 4,955,982.

In spite of this prior work, a need presently exists for an improved pavement marker that is easy to install, light in weight, and able to survive snowplowing operations without damage.

SUMMARY OF THE INVENTION

According to this invention, an improved payment marker is provided comprising a base, a resilient membrane comprising an outer portion secured to the base and an inner portion, and a reflector assembly secured to the inner portion of the membrane. This reflector assembly comprises a rigid reflector housing that preserves substantially a constant shape as the reflector housing is depressed toward the base, and the reflector assembly further comprises at least one reflector mounted in the reflector housing.

This invention is also directed to improved methods for installing a pavement marker and for removing a plurality of pavement markers, all as set out in the following claims.

BRIEF DESCRIPTION OF THE DRAWINGS

FIG. 3 is a top view of the reflector assembly of FIG. 1, prior to assembly with the membrane.

FIG. 4 is a side view taken along line 4—4 of FIG. 3.

FIG. 5 is a end view taken along line 5—5 of FIG. 3.

FIG. 6 is a top view of the reflector assembly and the membrane of FIG. 2, prior to installation in the frame.

FIG. 9 is an enlarged cross sectional view of a ring included the embodiment of FIG. 1.

FIG. 10 is an enlarged cross sectional view of an outer portion of a base included in the embodiment of FIG. 1.

DETAILED DESCRIPTION OF THE PREFERRED EMBODIMENTS

Figure 1:
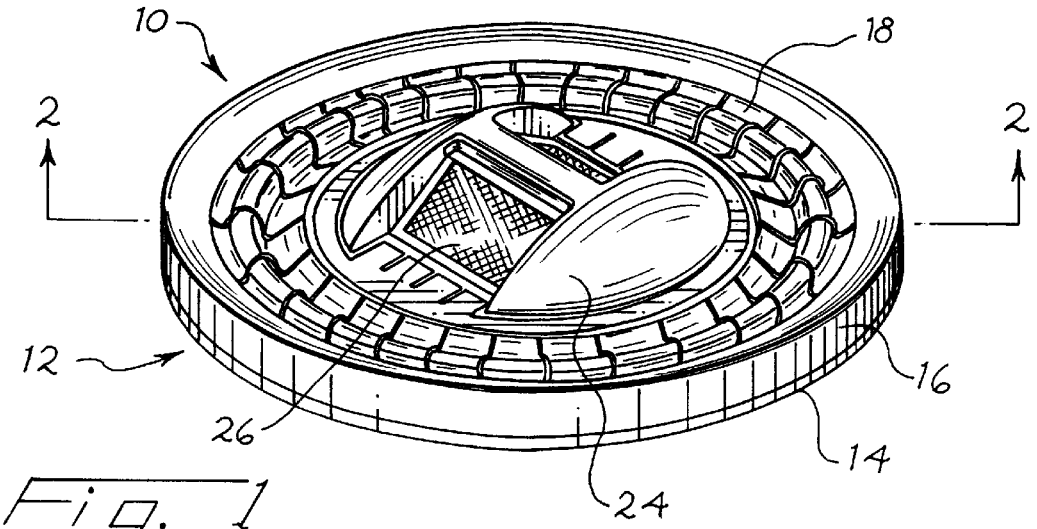
FIG. 1 is a perspective view of a pavement marker which incorporates a presently preferred embodiment of this invention.
Figure 2:
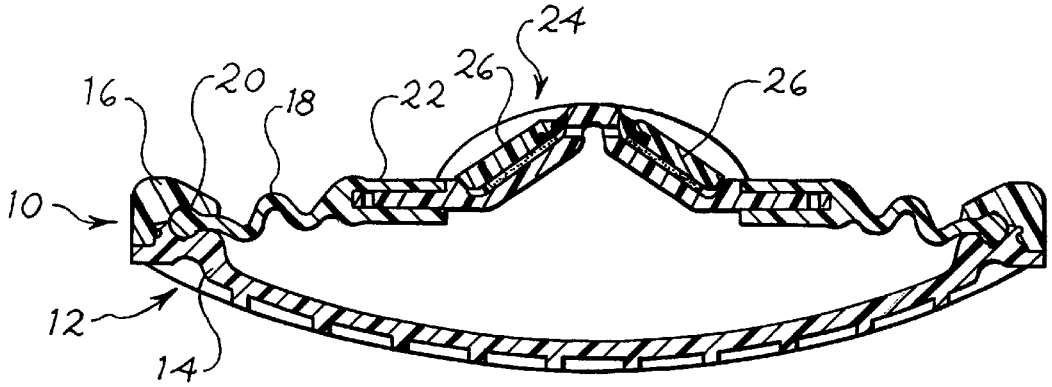
FIG. 2 is a cross-sectional view taken along line 2—2 of FIG. 1.

Turning now to the drawings, FIGS. 1 and 2 show two views of a pavement marker 10 which incorporates a presently preferred embodiment of this invention. The marker 10 includes a frame 12 which comprises a rigid polymeric base 14 and a rigid polymeric ring 16.

The pavement marker 10 also includes a resilient polymeric membrane 18 which includes an outer portion 20 secured in place in a weather proof fashion between the ring 16 and the base 14. The membrane 18 also includes an inner portion 22 secured to a reflector assembly 24 that supports two retroreflectors 26.

As shown in FIGS. 2–5, the reflector assembly 24 includes a reflector housing 25 which is preferably a rigid, molded polymeric element. The reflector housing 25 defines a central ridge 30 between the reflectors and two curved end faces 32, each at a respective end of the central ridge 30. The end faces 32 and the ridge 30 cooperate to form two pockets 28 that receive the respective reflectors in a snap fit. In this way, the reflectors are made removable from the reflector housing 25.

The reflector housing 25 defines a plurality of vents 34 that allow the movement of air into and out of the region between the reflector assembly 24 and the base 14. The outer periphery of the reflector housing 25 defines an array of openings 36 that interlock with portions of the membrane to secure the reflector housing 25 in place to the membrane.

Figure 7:
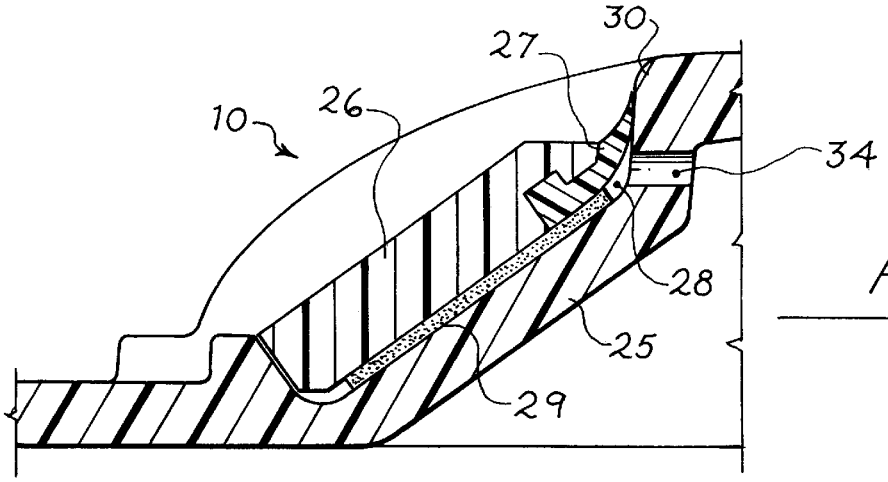
FIG. 7 is a fragmentary cross-sectional view taken along line 7—7 of FIG. 6.

As shown in FIG. 7, each reflector 26 includes a flexible seal 27 that seals against an upper portion of the ridge 30, partially around the respective pocket 28. This seal 27 restricts the movement of moisture into the vents 34, while allowing air to move out of the marker 10 when the reflector housing 25 is depressed. The seal 27 is preferably formed with shallow grooves against the housing 25 (not shown in FIG. 7) to allow air to pass slowly through the vents 34 as the reflector housing 25 returns to its original position. The reflector 26 may be held in the pocket 28 by butyl tape 29.

Figure 8:
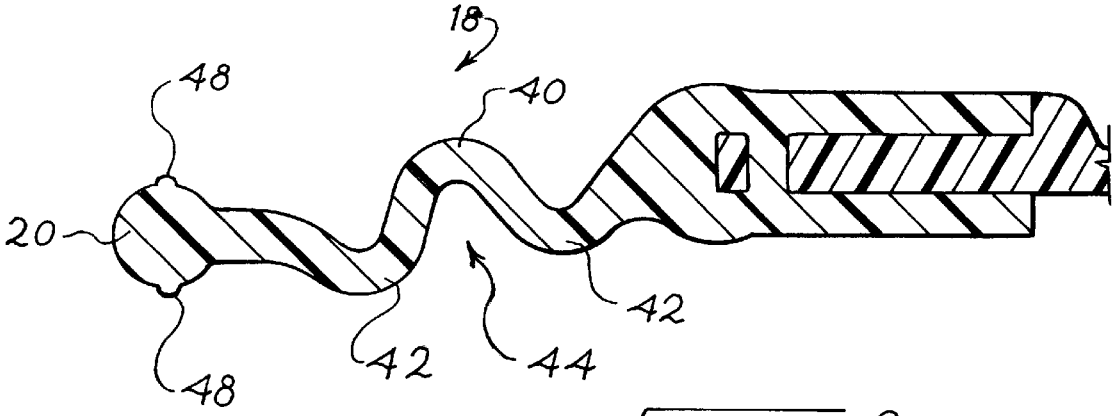
FIG. 8 is an enlarged cross sectional view taken along line 8—8 of FIG. 6.

As best shown in FIG. 8, the membrane 18 includes a raised annular portion 40 and a pair of spaced, concentric lowered annular portions 42 that cooperate to form a serpentine portion 44 when viewed in cross section. The outer portion 20 of the membrane 18 forms two raised circular beads 48 that assist in forming the weather-tight seal against the ring 16 and base 14, respectively. As best shown in FIG. 6, the membrane 18 preferably includes an array of radial ridges 46 extending between the outer portion 20 and in the inner portion 22.

Figure 11:
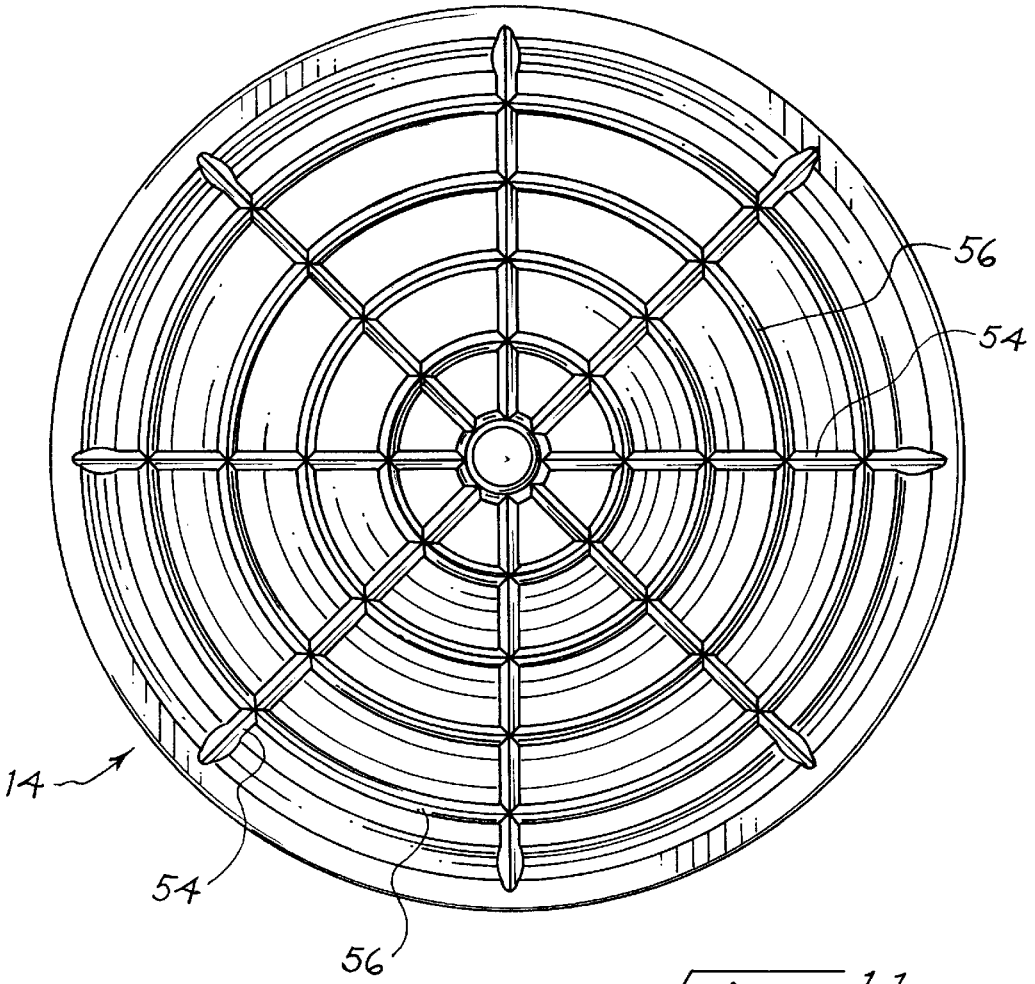
FIG. 11 is a bottom view of the embodiment of FIG. 1.

As shown in FIG. 9, the ring 16 includes a circular ridge 50 that is shaped to form a snap fit engagement with a circular groove 52 formed in the base 14 (FIG. 10). As also shown in FIG. 10, the base 14 forms a lower surface 58 that includes radial ridges 54 and concentric ridges 56. FIG. 11 is a bottom view that shows a preferred orientation for the ridges 54, 56.

The pavement marker 10 is preferably fabricated by first molding the base 14, the ring 16 and the reflector housing 25 out of suitable materials. Simply by way of example, the base 14 and the ring 16 can be molded from a polymer such as Nylon 6/6, fiber-reinforced with fibers such as metal, glass, or carbon fibers, and the reflector housing 25 can be molded from a polymer such as Nylon 6/6 filled with a metal powder. Preferably, glass reinforcement forms more than 40% of the weight of the base 14 and the ring 16. For example, the resin sold by D.S.M. Inc. as polyethylene resin number J-60/30/E can be used for the base 14 and ring 16, and the resin Akulon sold by D.S.M. Inc. can be used for the reflector housing 25. Alternately, the reflector housing can be die cast from nickel filled aluminum.

The next step is to mold the membrane 18 around the reflector housing 25, insuring that the polymer of the membrane 18 enters the openings 36 to securely attach the reflector housing 25 to the membrane 18. Simply by way of example, a silicone rubber with a durometer of 50 (Shore B) can be used, such as the polymer sold by G.E. Polymers as resin number SC106083. Preferably, a phosphorescent additive such as that sold by United Mineral and Chemical Corp. (Lyndhurst, N.J.) under the tradename LUMINOVA is used to make the membrane 18 luminescent. This additive absorbs sunlight during the day, and then causes the membrane 18 to glow in the dark for an extended period after sundown. In this way the visibility of the pavement marker 10 is further enhanced.

Once the membrane 18 has been formed, it can be placed on the base 14, and the ring 16 can be snapped in place to hold the assembly together. Preferably, the ring 16 is then sonically welded to the base 14 around its entire perimeter to create the desired weather-tight seal. The reflectors 26 may be formed of polycarbonate, and the seals 27 may be formed of silicone. Preferably the reflectors 26 are coated with a thin silicon layer to reduce surface scratching. For example, the Bayer Hardcoat process (Bayer A. G.) may be used. The reflectors 26 can be snapped in the pockets 28 at any appropriate time.

Simply by way of example, the frame 12 can have an outside diameter of 7 inches, and the membrane 16 can have a thickness of about 0.10 inches. The base 14 can have a thickness of about 0.125 inches, and the ridges 56, 58 can have a height of about 0.10 inches. The lower surfaced 58 is preferably circularly symmetrical and smoothly, convexly shaped, as shown.

The pavement marker 10 is preferably formed completely of polymeric materials, and it is light in weight. The reflectors 26 are readily replaceable, and the pavement marker 10 is designed for use on pavement that will be snow plowed. When a snow plow blade or a tire comes into contact with the reflector housing 25, downward forces are carried by the end faces 32 and the central ridge 30 to the membrane 18, thereby causing the membrane 18 to deflect downwardly, and allowing the snow plow blade or tire to pass over the pavement marker. After the snow plow blade or tire has passed, the resilience of the membrane 18 restores the reflector assembly 24 to the original raised position. The vents 34 allow rapid air movement during downward movement of the reflector assembly. The ridges 46 assist in causing the membrane 18 to maintain a symmetric shape as it resiliently deforms.

Figure 12:
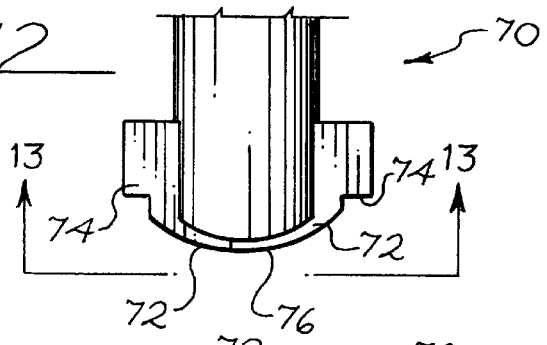
FIG. 12 is a side view of a cutting tool used to form a recess that receives the pavement marker of FIG. 1.
Figure 13:
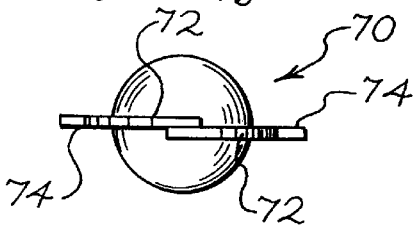
FIG. 13 is an end view taken along line 13—13 of FIG. 11.

The pavement marker 10 can be quickly installed, preferably with a rotary cutting tool 70 as shown in FIGS. 12 and 13. This cutting tool includes a pair of offset blades 72 that form a smoothly curved, convex cutting edge 76, which matches the contour of the lower surface 58 of the pavement marker 10. The tool also includes a stop 74 which limits the depth of the recess formed with the tool 70.

Figure 14:
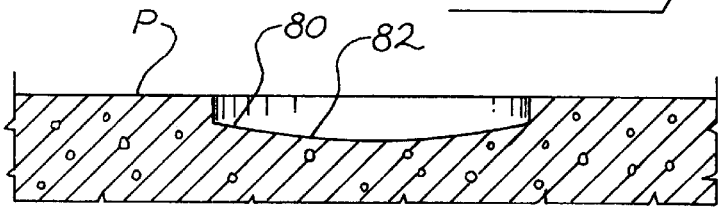
FIG. 14 is a cross sectional view of a recess in a roadway formed with the tool of FIG. 12.

As shown in FIG. 14, the first step in installing the pavement marker 10 is to form a recess 80 in the pavement P. The recess 80 includes a lower surface 82 which is circularly symmetrical, smoothly curved, and concave. The recess 80 can be formed simply by rotating the tool 70 about its central axis and advancing the tool 70 against the pavement P until the stop 74 limits further downward motion of the tool 70.

Figure 15:
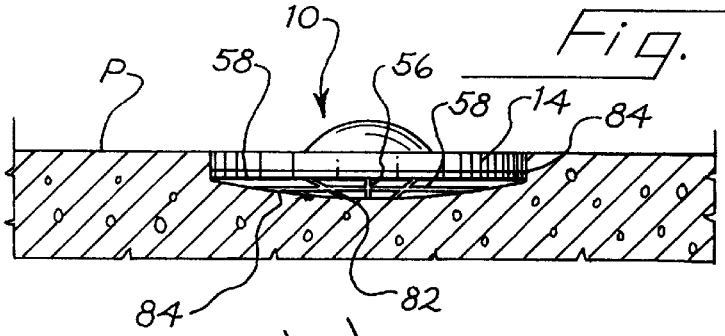
FIG. 15 is a cross sectional view showing a side elevational view the pavement marker of FIG. 1 mounted in the recess of FIG. 14.

Once the recess 80 has been formed, an adhesive 84 is applied against the lower surface 82. Any suitable all-weather adhesive having adequate bonding and adhesion properties can be used, including for example the adhesive sole under the tradename Liquid Nails, two-part epoxies, and other adhesives. Once the adhesive has been installed, the pavement marker 10 is then pressed into the recess 80 (FIG. 15). The ridges 56, 58 improve adhesion of the adhesive against the base 14. The smoothly curved, concave lower surface 82 of the recess 80 matches the smoothly curved, convex lower surface 58 of the pavement marker 10 and acts to distribute compressive loads into the pavement P, thereby minimizing any tendency of the pavement P to spall or crumble.

Figure 16:
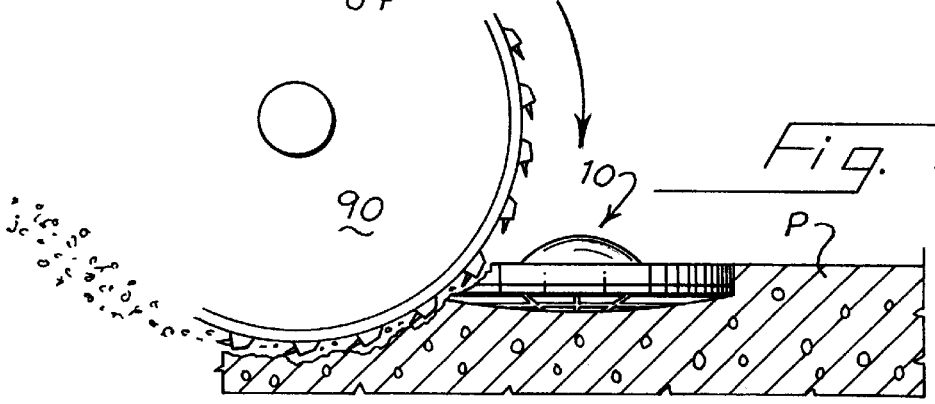
FIG. 16 is a cross sectional view corresponding to FIG. 15 showing the pavement marker of FIG. 1 in side elevational view and an upper portion of the roadway being removed by a cutting tool.

When it is desired to remove the pavement marker 10 from the pavement P, the pavement marker 10 can simply be pried out of the pavement P in the conventional manner. However, since the pavement marker 10 is entirely formed of polymeric materials in the preferred embodiment, it is often not necessary to remove individual pavement markers 10 when a roadway is being resurfaced. As shown in FIG. 16, a cutting tool 90 such as a road mill can be used to comminute both an upper layer of the pavement and the pavement marker 10 itself in a single pass, thereby reducing labor and speeding the highway repair project.

From the foregoing discussion it should be apparent that an improved highway pavement marker 10 has been described which is light in weight, easy to install, and easy to remove. The light weight of the pavement marker 10 provides safety advantages, in that the pavement marker 10 is unlikely to do substantial damage to a highway vehicle, even in the unlikely event that the pavement marker 10 should become displaced from the recess.

As another advantage, it is easy to adjust the forces tending to restore the reflector housing 25 to the raised position, simply by changing the durometer of the material used to form the membrane 18. In general a higher durometer material provides a higher recovery speed. In many applications it is important that the recovery speed not be excessively high, in order to minimize damage to the reflector housing 25 caused by a passing snow plow blade. In general, it is preferred that the time required for the reflector housing 25 to return to its raised position should be at least 1–3 seconds after impact by a passing object such as a snow blade.

Another important aspect of this invention is that the reflector housing 25 does not protrude substantially above the surface of the roadway. As shown in FIG. 15, the height of protrusion is designated by the symbol H. In order to provide a low profile to the reflector assembly 24 while still maintaining adequate visibility of the reflectors 26 at distance (for example, 100 feet) it is preferred that the ratio H/R, where R is the radius of the frame 12, be maintained at a value less than 0.20. In the preferred example H=0.6 inch, R=3.5 inches, and H/R=0.17.

As another advantage, the reflector assembly 24 (without the membrane 18) may be adhered directly to a roadway surface in regions where roads are not snow plowed. In this case, it is preferred to provide a waffle pattern on the bottom of the reflector assembly 24 to improve adhesion to the roadway surface.

Of course, it should be understood that many changes and modifications can be made to the preferred embodiments described above. Materials, shapes, and dimensions can all be modified as appropriate for the particular application. In some cases it may be preferable to hold the base 14 in place with nails or stakes rather than or in addition to adhesive. In some cases a bayonet mount may be preferable between the ring 16 and the base 14. It is not necessary in all cases that there be two reflectors, and in some cases it may be preferred to use a central cylindrical reflector.

It is therefore intended that the foregoing detailed description be regarded as an illustration of one form that the invention can take, and not as a definition of the invention. It is only the following claims, including all equivalents, which are intended to define the scope of this invention.

What is claimed is:

1. A pavement marker comprising:

a frame comprising a base;

a resilient membrane comprising an outer portion secured to the base and an inner portion;

a reflector assembly secured to the inner portion of the membrane, said reflector assembly comprising a rigid reflector housing preserving substantially a constant shape as the reflector housing is depressed toward the base, said reflector assembly further comprising at least one reflector mounted in the reflector housing, and an upper surface extending and inclined forwardly of the reflector and positioned to receive forces applied to the reflector assembly by a snow plow blade; and at least one air vent formed in an upper portion of the pavement marker to vent air from an interior portion of the pavement marker when the reflector assembly moves downwardly;

wherein the membrane is annular in shape;

wherein the membrane comprises an array of alternating raised and lowered annular portions such that a cross section of the membrane between the inner and outer portions comprises a serpentine portion;

wherein the membrane further comprises an array of radial ridges extending between the inner and outer portions.

2. A method for installing a pavement marker comprising the following steps:

(a) forming a circularly symmetrical recess in a roadway, said recess comprising a smoothly curved, concave, central lower surface substantially circularly symmetrical about an axis substantially perpendicular to a surface of the roadway;

(b) applying an adhesive in the recess; and (c) installing a pavement marker in the recess over the adhesive, said pavement marker comprising a smoothly curved, convex outer contour that is downwardly domed in side elevation and that substantially matches the smoothly curved, concave, central lower surface of the recess.

3. The method of claim 2 wherein the convex outer contour of the pavement marker installed in step (c) comprises a peripheral portion and a central portion, said central portion extending farther below a surface of the roadway than any part of the peripheral portion.

4. The method of claim 2 wherein the pavement marker comprises a lower surface comprising an unperforated lowermost central portion, said lower surface defining the outer contour that is downwardly domed in side elevation.

5. A pavement marker comprising:

a frame comprising a base;

a resilient membrane comprising an outer portion secured to the base and an inner portion; and a reflector assembly secured to the inner portion of the membrane, said reflector assembly comprising a rigid reflector housing preserving substantially a constant shape as the reflector housing is depressed toward the base, said reflector assembly further comprising at least one reflector mounted in the reflector housing, and an upper surface extending and inclined forwardly of the reflector and positioned to receive forces applied to the reflector assembly by a snow plow blade;

wherein the base comprises a lower surface, and wherein the lower surface is convexly curved, downwardly domed in side elevational view, and substantially circularly symmetrical about an axis that passes centrally through the reflector assembly and the base.

6. The invention of claim 5 wherein the lower surface comprises a peripheral portion and a central portion, and wherein the central portion extends farther from an upper portion of the frame than any part of the peripheral portion.

7. The invention of claim 5 wherein said lower surface comprises an unperforated lowermost central portion.

8. A pavement marker comprising:

a frame comprising a base;

a resilient membrane comprising an outer portion secured to the base and an inner portion;

a reflector assembly secured to the inner portion of the membrane, said reflector assembly comprising a rigid reflector housing preserving substantially a constant shape as the reflector housing is depressed toward the base, said reflector assembly further comprising at least one reflector mounted in the reflector housing, and an upper surface extending and inclined forwardly of the reflector and positioned to receive forces applied to the reflector assembly by a snow plow blade;

wherein the reflector housing comprises an array of openings; and wherein the reflector housing is insert molded in the inner portion of the membrane with the membrane extending continuously around the reflector housing through the openings.

9. A pavement marker comprising:

a frame comprising a base;

a resilient membrane comprising an outer portion secured to the base and an inner portion;

a reflector assembly secured to the inner portion of the membrane, said reflector assembly comprising a rigid reflector housing preserving substantially a constant shape as the reflector housing is depressed toward the base, said reflector assembly further comprising at least one reflector mounted in the reflector housing, and an upper surface extending and inclined forwardly of the reflector and positioned to receive forces applied to the reflector assembly by a snow plow blade; and at least one air vent formed in an upper portion of the pavement marker to vent air from an interior portion of the pavement marker when the reflector assembly moves downwardly;

wherein the membrane is annular in shape and comprises an array of alternating raised and lowered annular portions such that a cross section of the membrane between the inner and outer portions comprises a serpentine portion;

wherein the membrane further comprises an array of radial ridges extending between the inner and outer portions.

* * * * *